US009534604B2

(12) United States Patent
Lopez et al.

(10) Patent No.: US 9,534,604 B2
(45) Date of Patent: Jan. 3, 2017

(54) SYSTEM AND METHOD OF CONTROLLING MANIFOLD FLUID FLOW

(71) Applicant: Schlumberger Technology Corporation, Sugar Land, TX (US)

(72) Inventors: Miguel Lopez, Houston, TX (US); Marcos Suguru Kajita, Houston, TX (US); Christopher Shen, Houston, TX (US); William Troy Huey, Fulshear, TX (US); Sarmad Adnan, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 892 days.

(21) Appl. No.: 13/826,667

(22) Filed: Mar. 14, 2013

(65) Prior Publication Data

US 2014/0277772 A1 Sep. 18, 2014

(51) Int. Cl.

| | |
|---|---|
| ***F04D 13/00*** | (2006.01) |
| ***F04D 15/00*** | (2006.01) |
| ***F04D 13/12*** | (2006.01) |
| ***F04D 15/02*** | (2006.01) |

(52) U.S. Cl.
CPC ..... *F04D 13/12* (2013.01); *F04D 15/029* (2013.01)

(58) Field of Classification Search
CPC ..... F04D 13/12; F04D 15/029
See application file for complete search history.

(56) References Cited

U.S. PATENT DOCUMENTS

| | | | | |
|---|---|---|---|---|
| 4,845,981 | A | 7/1989 | Pearson | |
| 5,107,441 | A * | 4/1992 | Decker | E21B 43/123 137/155 |
| 5,382,411 | A * | 1/1995 | Allen | B01F 3/1271 366/153.1 |
| 5,426,137 | A * | 6/1995 | Allen | B01F 3/1271 366/158.4 |
| 5,799,688 | A * | 9/1998 | Yie | B05B 1/3046 137/505.13 |
| 5,964,985 | A * | 10/1999 | Wootten | B01D 53/24 201/14 |

(Continued)

*Primary Examiner* — Mohammad Ali
*Assistant Examiner* — Kelvin Booker
(74) *Attorney, Agent, or Firm* — Andrea E. Tran; Tim Curington

(57) ABSTRACT

A manifold trailer and pairing system are disclosed. The pairing system has a non-transitory computer readable medium storing processor executable code. The processor executable code causes a processor to receive identification data indicative of a first low pressure valve and a second low pressure valve connected to a low pressure manifold of a manifold trailer; receive identification data indicative of a first high pressure valve and a second high pressure valve connected to a high pressure manifold of the manifold trailer; and receive identification data indicative of a plurality of pumps. The processor determines a first association indicative of a first fluid connection between the first low pressure valve and a selected pump and a second association indicative of a second fluid connection between the selected pump and a selected high pressure valve. The processor populates the non-transitory computer readable medium with information indicative of the first and second associations.

15 Claims, 13 Drawing Sheets

(56) References Cited

U.S. PATENT DOCUMENTS 7,627,397 B2 12/2009 Parraga
7,845,413 B2 * 12/2010 Shampine ..... E21B 43/267 166/105
8,151,885 B2 4/2012 Bull et al.
9,328,575 B2 * 5/2016 Feasey ..... E21B 7/12
2003/0168258 A1 * 9/2003 Koederitz ..... E21B 21/08 175/38
2005/0042151 A1 * 2/2005 Alward ..... B01D 39/2082 422/177
2006/0014999 A1 * 1/2006 Heilman ..... A61M 1/1037 600/16
2006/0081378 A1 * 4/2006 Howard ..... E21B 43/12 166/372
2006/0171860 A1 * 8/2006 Ross ..... A62B 21/00 422/120
2008/0060846 A1 * 3/2008 Belcher ..... E21B 17/042 175/25
2008/0262737 A1 * 10/2008 Thigpen ..... E21B 43/00 166/369
2009/0120635 A1 5/2009 Neal
2009/0236144 A1 * 9/2009 Todd ..... E21B 17/01 175/40
2009/0283259 A1 * 11/2009 Poitzsch ..... E21B 43/26 166/250.01
2009/0283261 A1 * 11/2009 Poitzsch ..... E21B 19/22 166/250.02
2010/0086414 A1 * 4/2010 Tai ..... B60K 6/12 417/34
2010/0101785 A1 * 4/2010 Khvoshchev ..... E21B 34/16 166/250.01
2010/0288507 A1 * 11/2010 Duhe ..... E21B 21/08 166/370
2011/0214920 A1 * 9/2011 Vail, III ..... E21B 33/10 175/57
2011/0272158 A1 11/2011 Neal
2012/0073670 A1 * 3/2012 Lymberopoulos ..... F04B 23/00 137/565.01
2012/0090807 A1 * 4/2012 Stewart ..... F03G 7/04 165/45
2012/0235829 A1 * 9/2012 Adnan ..... E21B 41/00 340/854.9
2013/0073174 A1 * 3/2013 Worden ..... F02D 41/22 701/102
2013/0098632 A1 * 4/2013 Wetzel ..... E21B 43/128 166/373
2013/0192841 A1 * 8/2013 Feasey ..... E21B 21/08 166/336
2013/0199792 A1 * 8/2013 Backes ..... E21B 43/0122 166/335
2013/0204922 A1 * 8/2013 El-Bakry ..... G06Q 10/06 709/202
2013/0213647 A1 * 8/2013 Roddy ..... E21B 47/01 166/255.1
2013/0223979 A1 * 8/2013 Locke ..... F04B 49/065 415/1
2013/0233542 A1 * 9/2013 Shampine ..... E21B 43/267 166/279
2013/0299240 A1 * 11/2013 Leuchtenberg ..... E21B 21/08 175/48
2014/0044508 A1 * 2/2014 Luharuka ..... E21B 15/00 414/293
2014/0048331 A1 * 2/2014 Boutalbi ..... E21B 21/08 175/38
2014/0262338 A1 * 9/2014 Shen ..... B01F 5/16 166/381
2015/0129210 A1 * 5/2015 Chong ..... E21B 33/13 166/280.1
2015/0166260 A1 * 6/2015 Pham ..... B65D 88/30 414/471

* cited by examiner

SYSTEM AND METHOD OF CONTROLLING MANIFOLD FLUID FLOW

BACKGROUND

Hydraulic fracturing is among the varied oilfield operations used to produce petroleum products from underground formations. In hydraulic fracturing, a fluid is pumped down a wellbore at a flow rate and pressure sufficient to fracture a subterranean formation. After the fracture is created or, optionally, in conjunction with the creation of the fracture, proppants may be injected into the wellbore and into the fracture. The proppant is a particulate material added to the pumped fluid to produce a slurry. The proppant within the fracturing fluid forms a proppant pack to prevent the fracture from closing when pressure is released, providing improved flow of recoverable fluids, i.e. oil, gas, or water. The success of hydraulic fracturing treatment is related to the fracture conductivity which is the ability of fluids to flow from the formation through the proppant pack. In other words, the proppant pack or matrix may have a high permeability relative to the formation for fluid to flow with low resistance to the wellbore. Permeability of the proppant matrix may be increased through distribution of proppant and non-proppant materials within the fracture to increase porosity within the fracture.

Some approaches to hydraulic fracturing conductivity have constructed proppant clusters in the fracture, as opposed to constructing a continuous proppant pack. These methods may alternate stages of proppant-laden and proppant free fracturing fluids to create proppant clusters in the fracture and open channels between them for formation fluids to flow. Thus, the fracturing treatments result in a heterogeneous proppant placement (HPP) and a "room and pillar" configuration in the fracture, rather than a homogeneous proppant placement and consolidated proppant pack. The amount of proppant deposited in the fracture during each HPP stage is modulated by varying the fluid transport characteristics, such as viscosity and elasticity; the proppant densities, diameters, and concentrations; and the fracturing fluid injection rate.

Pumping this slurry at the appropriate flow rate and pressure to create and maintain the fracture of rock strata is a severe pump duty. In fracturing operations each fracturing pump may pump up to twenty barrels per minute at pressures up to 20,000 psi. The fracturing pumps for this application are quite large and are frequently moved to the oilfield on semi-trailer trucks or the like.

In large fracturing operations, it is common to have a common manifold, called a missile, missile trailer or manifold trailer, connected to multiple fracturing pumps. The manifold trailer distributes the fracturing fluid at low pressure from a blender to the fracturing pumps. The fracturing pumps pressurize the slurry, which is collected by the manifold trailer from the fracturing pumps to deliver downhole into a wellbore. Valves on the manifold trailer connected to the fracturing pumps are completely manual in current fracturing operations. In current operations the fracturing pumps are manually connected to the manifold trailer and pairs of fracturing pumps and valves are manually identified prior to pumping.

The fracturing pumps are independent units plumbed to the manifold trailer at a job site of a fracturing operation. A particular pump will likely be hooked up differently to the manifold trailer at different job sites. A sufficient number of pumps are connected to the manifold trailer to produce a desired volume and pressure output. For example, some fracturing jobs have up to 36 pumps, each of which may be connected to distinct valves on the manifold trailer.

The manual connection between each pump and manifold inlet/outlet of the valves may result in miscommunication between a pump operator and an outside supervisor who opens and closes the valves on the manifold trailer. The miscommunication of the association of the valve to the pump may cause the wrong valves to be opened and closed. Opening the wrong valve causes the pump to pump against a closed valve and over pressurize the line causing service quality, health, safety, and environmental risks and financial loss as well as downtime for the fracturing operation. Currently, no known method exists to automatically pair pumps to manifold trailer valves to avoid potential miscommunication and opening or closing of unintended valves.

SUMMARY

This summary is provided to introduce a selection of concepts that are further described in the detailed description. This summary is not intended to identify key or essential features of the claimed subject matter, nor is it intended to be used as an aid in limiting the scope of the claimed subject matter.

In one embodiment, a non-transitory computer readable medium is described. The non-transitory computer readable medium stores processor executable code that when executed by a processor causes the processor to receive identification data indicative of a first low pressure valve and a second low pressure valve, receive identification data indicative of a first high pressure valve and a second high pressure valve, and receive identification data indicative of a plurality of pumps. The first and second low pressure valves are each connected to a low pressure manifold of a manifold trailer. The first pressure valve is connected to a high pressure manifold of the manifold trailer at a first high pressure station and the second high pressure valve is connected to the high pressure manifold of the manifold trailer at a second high pressure station. The processor determines a first association indicative of a first fluid connection between the first low pressure valve and a selected pump of the plurality of pumps and a second association indicative of a second fluid connection between the selected pump and a selected high pressure valve. The selected high pressure valve is selected from the first and second high pressure valves. The processor populates a non-transitory computer readable medium (e.g., Random Access Memory (RAM) with information indicative of the first fluid connection and the second fluid connection. In another embodiment, the processor populates the non-transitory computer readable medium with information indicative of the first association indicative of the first fluid connection and the second association indicative of the second fluid connection.

In one embodiment, the processor determines the first fluid connection and the second fluid connection by pressurizing the low pressure manifold, opening the first low pressure valve, detecting a pressure increase on the selected pump via a first pressure sensor and closing the first low pressure valve retaining pressure between the first low pressure valve and the selected pump. The processor then associates the first low pressure valve with the selected pump. The processor selectively opens and closes, individually, the first or second high pressure valves, and detects a pressure decrease on the selected pump via a second pressure sensor for a selected high pressure valve. The selected high pressure valve is selected from the first and second high pressure valves. The processor then associates the selected high pressure valve with the selected pump within the non-transitory computer readable medium.

In another version, a computerized method is presented for pairing low pressure valves and high pressure valves on a manifold trailer with pumps. The method is performed by pressurizing a low pressure manifold having a first low pressure valve and a second low pressure valve. The manifold trailer is also provided with a first high pressure valve and a second high pressure valve connected to a high pressure manifold. The low pressure manifold and the high pressure manifold are in fluid communication with a plurality of pumps. A selected one of the first and second low pressure valves is opened. A pressure increase is detected on a selected pump of a plurality of pumps by a first pressure sensor. The selected low pressure valve is closed, retaining the pressure between the selected low pressure valve and the selected pump and then the selected low pressure valve is associated with the selected pump and information indicative of the association is stored in a non-transitory computer readable medium. The first and second high pressure valves are individually opened and closed and a pressure decrease is detected on the selected pump, corresponding to the opening of a selected high pressure valve of the first and second high pressure valves. The pressure decrease is detected via a second pressure sensor. The selected high pressure valve is then associated with the selected pump. In one embodiment, the first pressure sensor and the second pressure sensor are the same sensor.

In another embodiment, the present disclosure describes a manifold trailer. The manifold trailer is provided with a low pressure manifold having a first low pressure valve and a second low pressure valve, a high pressure manifold having a first high pressure valve and a second high pressure valve, a plurality of actuators, and a computer system. The plurality of actuators are provided with a first actuator connected to the first low pressure valve, a second actuator connected to the second low pressure valve, a third actuator connected to the first high pressure valve, and a fourth actuator connected to the second high pressure valve. The computer system has a processor and processor executable code which causes the processor to transmit signals to the first, second, third, and fourth actuators to selectively open and close the first and second low pressure valves and the first and second high pressure valves.

To form associations between the plurality of actuators and particular pumps, the processor of the computer system opens the first low pressure valve, detecting a pressure increase on a selected pump via a first pressure sensor and closing the first low pressure valve retaining pressure between the first low pressure valve and the selected pump. The processor then associates the first low pressure valve with the selected pump and stores information indicative of the association within the non-transitory computer readable medium. The processor selectively opens and closes, individually, the first and second high pressure valves, and detects a pressure decrease on the selected pump via a second pressure sensor for a selected high pressure valve of the first and second high pressure valves. The processor then stores information indicative of an association s of the selected high pressure valve with the selected pump within the non-transitory computer readable medium.

BRIEF DESCRIPTION OF DRAWINGS

Certain embodiments of the present inventive concepts will hereafter be described with reference to the accompanying drawings, wherein like reference numerals denote like elements, and.

DETAILED DESCRIPTION

Specific embodiments of the present disclosure will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Figure 1:
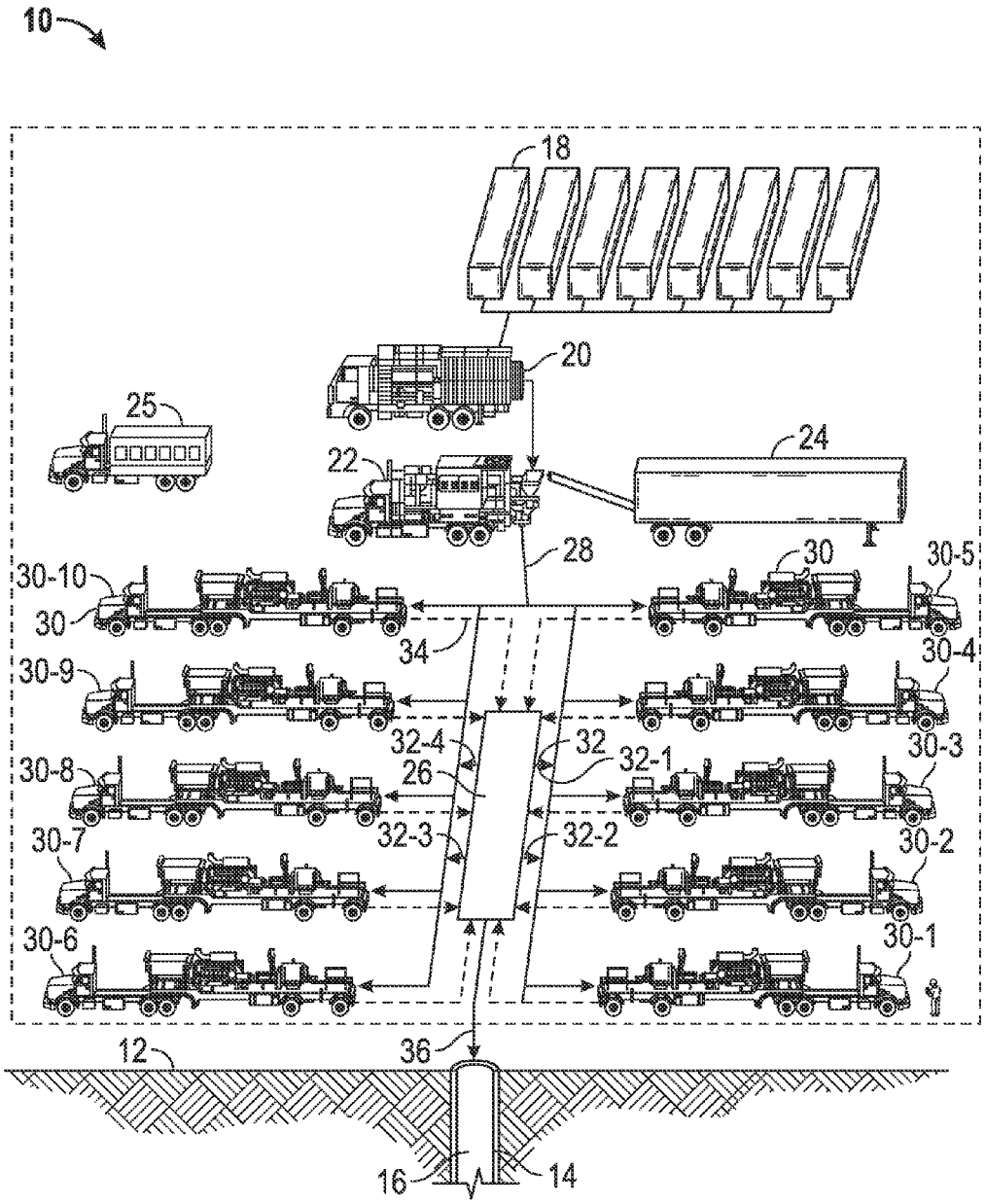
FIG. 1 is a perspective view of an embodiment of an oilfield operation in accordance with the present disclosure.

Referring now to the figures, shown in FIG. 1 is an example of an oilfield operation, also known as a job. A pump system 10 is shown for pumping a fluid from a surface 12 of a well 14 to a well bore 16 during the oilfield operation. In this particular example, the operation is a hydraulic fracturing operation, and hence the fluid pumped is a fracturing fluid, also called a slurry. As shown, the pump system 10 includes a plurality of water tanks 18, which feeds water to a gel maker 20. The gel maker 20 combines water from the water tanks 18 with a gelling agent to form a gel. The gel is then sent to a blender 22 where it is mixed with a proppant from a proppant feeder 24 to form the fracturing fluid. A computerized control system 25 may be employed to direct at least a portion of the pump system 10 for the duration of a fracturing operation. The gelling agent increases the viscosity of the fracturing fluid and allows the proppant to be suspended in the fracturing fluid. It may also act as a friction reducing agent to allow higher pump rates with less frictional pressure.

The fracturing fluid is then pumped at low pressure (for example, around 50 to 80 psi) from the blender 22 to a common manifold 26, also referred to herein as a manifold trailer or missile, as shown by solid line 28. The manifold 26 may then distribute the low pressure slurry to a plurality of plunger pumps 30, also called fracturing pumps, fracturing pumps, or pumps, as shown by solid lines 32. Each fracturing pump 30 receives the fracturing fluid at a low pressure and discharges it to the manifold 26 at a high pressure as shown by dashed lines 34. The manifold 26 then directs the fracturing fluid from the pumps 30 to the well bore 16 as shown by solid line 36. A plurality of valves on the manifold 26, which will be described in further detail below, may be connected to the fracturing pumps 30. Programs within the computerized control system 25, described in more detail below, may be used to automate the valves and automatically pair the valves with the pumps 30 accurately to create an interlock between the pumps 30 and the manifold 26.

As will be explained below in further detail, the computerized control system 25 may first identify valves which have hoses connected between the valves and the fracturing pumps 30, and may pressurize a low pressure manifold common to the valves using the blender 22, the valves common to the low pressure manifold being a subset of the valves on the manifold trailer 26. The control system 25 may open the valves that are connected by the hoses to the pumps 30, while ignoring those valves without hose connections. The valves may be individually opened causing one of the fracturing pumps 30 to register a pressure on a suction pressure sensor within the pump 30. The fracturing pump 30 may then be paired with the valve that was opened to cause the pressure and the pairing may be recorded. The same low pressure valve may be closed leaving the pressure trapped in a line of the fracturing pump 30. Sequentially, high pressure valves that are unassigned, a subset of the valves connected to the manifold 26 may be individually opened. If one of the high pressure valves is opened and pressure is not bled from the pump, the pairing of the fracturing pump 30 and the high pressure valve is discarded. If the high pressure valve is opened and the fracturing pump 30 loses pressure, the pairing of the fracturing pump 30 and the high pressure valve is recorded. The high pressure valve may then be closed and the process repeated for a subsequent low pressure valve, a subsequent pump, and a subsequent high pressure valve. If one of the fracturing pumps 30 goes offline, the pairings involving that fracturing pump 30 may be discarded. Embodiments of the pairing operations of the computerized control system 25 are explained in further detail below with regards to FIGS. 8-9 and 15-16.

The fracturing pumps 30 may be independent units which are plumbed to the manifold trailer 26 at a site of the oilfield operations for each oilfield operation in which they are used. A particular fracturing pump 30 may be connected differently to the manifold trailer 26 on different jobs. The fracturing pumps 30 may be provided in the form of a pump mounted to a standard trailer for ease of transportation by a tractor. The pump 30 may include a prime mover that drives a crankshaft through a transmission and a drive shaft. The crankshaft, in turn, may drive one or more plungers toward and away from a chamber in the pump fluid end in order to create pressure oscillations of high and low pressure in the chamber. These pressure oscillations allow the pump to receive a fluid at a low pressure and discharge it at a high pressure via one way valves (also called check valves). Also connected to the prime mover may be a radiator for cooling the prime mover. In addition, the plunger pump fluid end may include an intake pipe for receiving fluid at a low pressure and a discharge pipe for discharging fluid at a high pressure.

Figure 2:
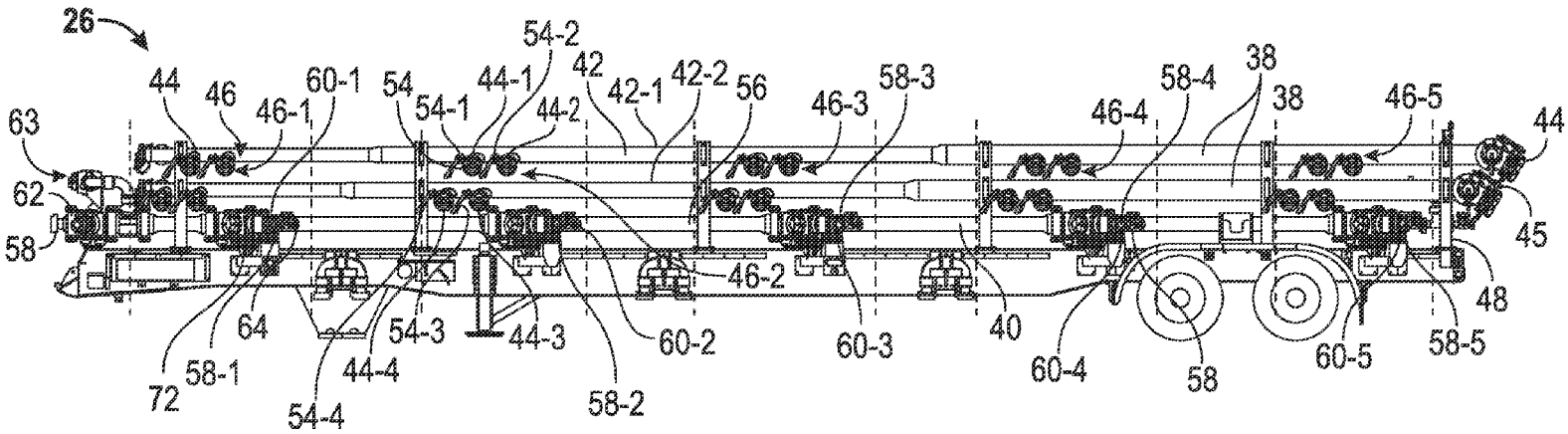
FIG. 2 is a side elevational view of an embodiment of a manifold trailer in accordance with the present disclosure.
Figure 3:
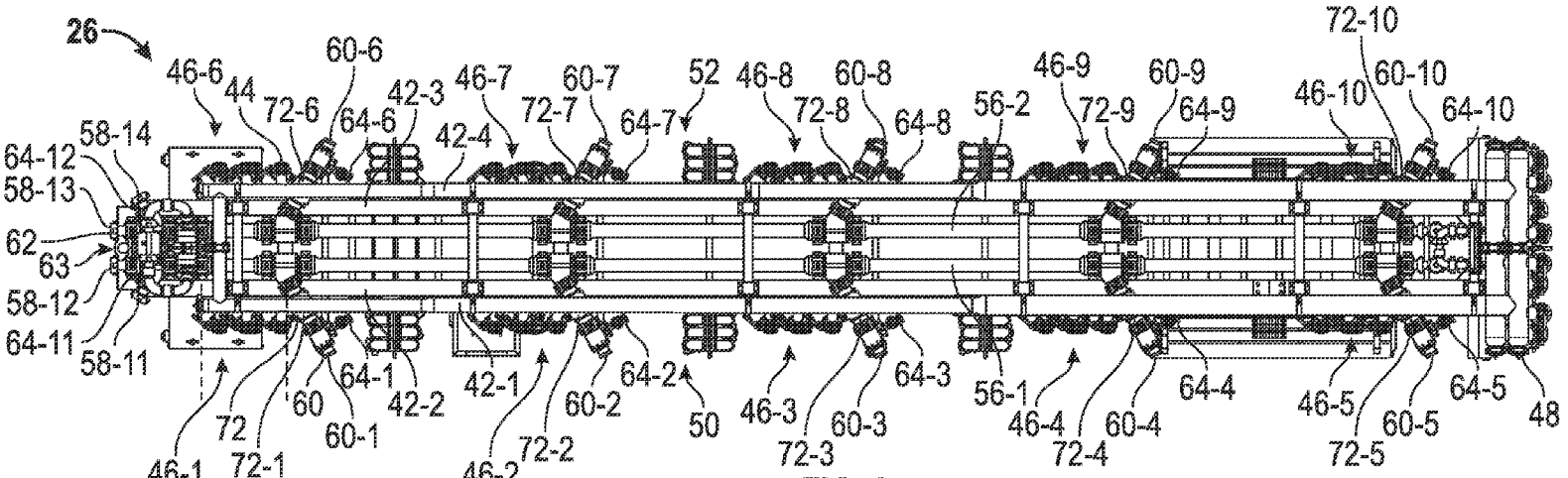
FIG. 3 is a top plan view of the manifold trailer of FIG. 2.
Figure 4:
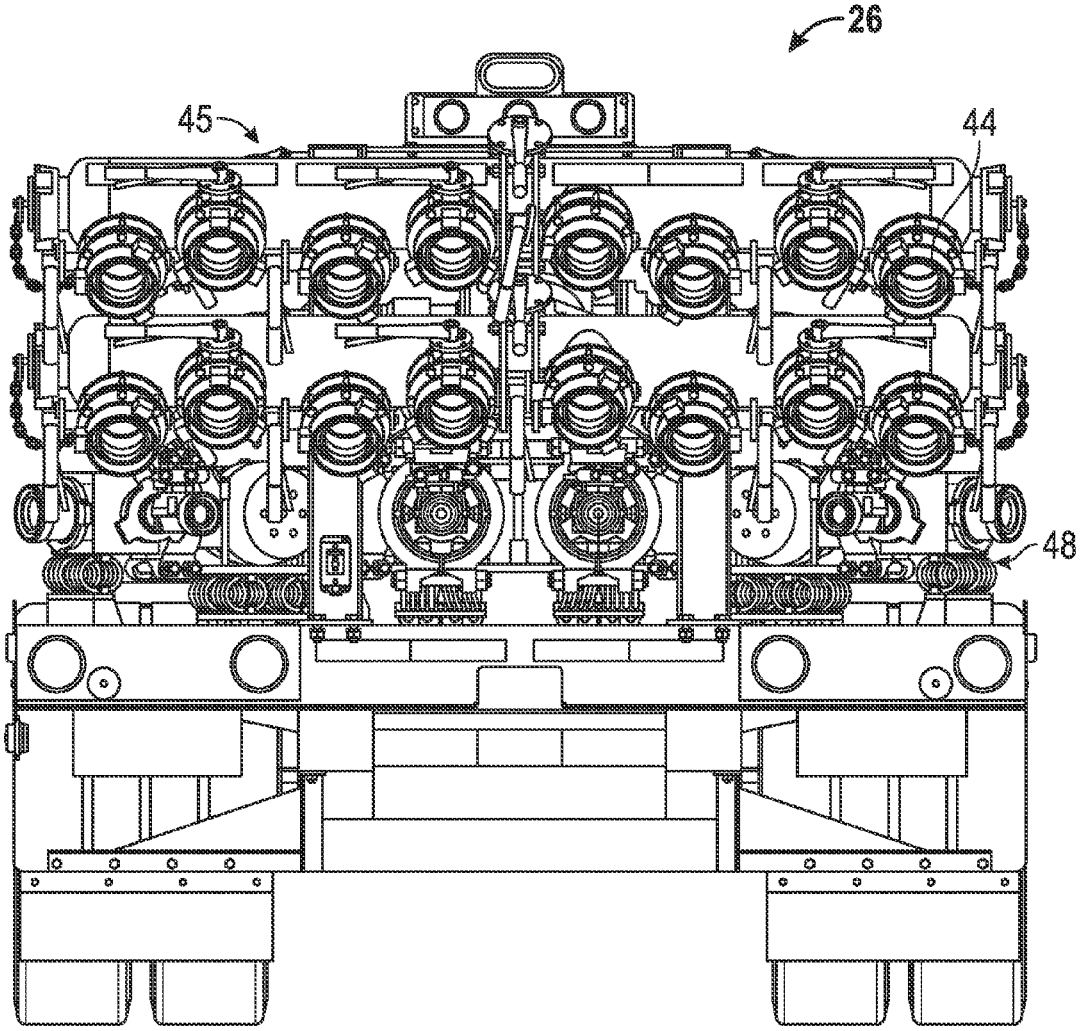
FIG. 4 is a rear elevational view of the manifold trailer of FIG. 2.

Referring now to FIGS. 2-4, therein shown is one embodiment of the manifold trailer 26, which distributes the low pressure slurry from the blender 22 to the plurality of fracturing pumps 30 and collects high pressure slurry from the fracturing pumps 30 to deliver to the well bore 16. The manifold trailer 26 may be provided with a low pressure manifold 38 in fluid communication with the blender 22 and the fracturing pumps 30 and a high pressure manifold 40 in fluid communication with the fracturing pumps 30. The low pressure manifold 38 may be in communication with the blender 22 to receive the slurry and the fracturing pumps 30 to distribute the slurry at low pressure. The high pressure manifold 40 may be in fluid communication with the fracturing pumps 30 to receive the slurry, at high pressure, and the well bore 16 to distribute the slurry to a downhole formation surrounding the well bore 16.

The low pressure manifold 38 may be provided with one or more pipes 42, a plurality of connections 44 for fluid communication between the pipes 42 and the blender 22 or the pipes 42 and the fracturing pumps 30, a blender station 45 for controlling fluid communication between the low pressure manifold 38 and the blender 22, and one or more low pressure stations 46 for controlling the fluid communication between the fracturing pumps 30 and the low pressure manifold 38. As shown in FIG. 3, the low pressure manifold 38 is provided with four pipes 42-1-42-4, each of the pipes

42-1-42-4 are in fluid communication with certain of the plurality of connections 44 to receive slurry from the blender 22 at the blender station 45 and to distribute the slurry at the one or more low pressure stations 46. As shown in FIG. 4, the blender station 45 may be located at a first end 48 of the manifold trailer 26 and be provided with a plurality of connections 44 to connect the blender 22 to the low pressure manifold 38.

The low pressure stations 46, as shown in one embodiment in FIGS. 1 and 3, may be located on second and third opposing sides 50 and 52, respectively, such that the low pressure stations 46-1-46-5 may be in fluid communication with the pumps 30-1-30-5 and the low pressure stations 46-6-46-10 may be in fluid communication with the pumps 30-6-30-10, for example. The low pressure stations 46 may be provided with certain of the plurality of connections 44. As shown in FIG. 2, for example, each low pressure station 46 may be provided with four connections 44-1-44-4. Each of the connections 44 may be provided with a low pressure valve 54 such that the low pressure manifold 38 has a plurality of low pressure valves 54, with each low pressure valve 54 being configured to control the fluid communication between one of the connections 44 and one of the fracturing pumps 30. As shown in FIG. 2, each low pressure station 46 may be provided with four connections 44-1-44-4 and four low pressure valves 54-1-54-4 corresponding to one of the four connections 44-1-44-4. It will be understood to one skilled in the art that the low pressure stations 46 may have varying numbers of connections such as single or multiple connections to a single fracturing pump 30.

The high pressure manifold 40 may be provided with one or more pipes 56, a plurality of connections 58 for fluid communication between the fracturing pumps 30 and the well bore 16, one or more high pressure stations 60 for controlling fluid communication between the fracturing pumps 30 and the high pressure manifold 40, and a well bore station 62 for controlling fluid communication between the high pressure manifold 40 and the well bore 16. As shown in FIG. 3, in one embodiment, the high pressure manifold 40 may be provided with two pipes 56-1 and 56-2 in fluid communication with certain of the plurality of connections 58 to receive slurry from the fracturing pumps 30 at each high pressure station 60 and to distribute the high pressure slurry at the well bore station 62. As shown in FIGS. 2 and 3, the well bore station 62 may be located at a fourth end 63 of the manifold trailer 26 opposite the first end 48, and may be provided with certain of the plurality of connections 58 to connect the high pressure manifold 40 with the well bore 16.

The high pressure stations 60, as shown in one embodiment in FIGS. 1 and 3, may be located on the second and third opposing sides 50 and 52, respectively, such that the high pressure stations 60-1-60-5 may be in fluid communication with the pumps 30-1-30-5 and the high pressure stations 60-6-60-10 may be in fluid communication with the pumps 30-6-30-10, for example. The high pressure stations 60 may be provided with certain of the plurality of connections 58. As shown in FIG. 2, for example, each high pressure station 60 may be provided with a single connection 58 and the well bore station 62 may be provided with four connections 58-11-58-14. Each of the connections 58 may be provided with a high pressure bleed valve 64 and a plug valve 72 such that the high pressure manifold 40 has a plurality of high pressure bleed valves 64 and a plurality of plug valves 72, with each plug valve 72 being configured to control the fluid communication between one of the connections 58 and one of the fracturing pumps 30 or between one of the connections 58 and the well bore 16 and each high pressure bleed valve 64 being configured to hold pressure and when opened to bleed pressure present at the connection 58. As shown in FIG. 2, each of the high pressure stations 60-1-60-5 is provided with a single connection 58-1-58-5, a high pressure bleed valve 64-1-64-5 and a plug valve 72-1-72-5, and the well bore station 62 is provided with four connections 58-11-58-14.

In one embodiment, the low pressure manifold 38 may be provided as two low pressure manifolds 38, along with the high pressure manifold 40. The two low pressure manifolds 38 may be used for split stream operations such as described in U.S. Pat. No. 7,845,413 which is hereby incorporated by reference.

Figure 5:
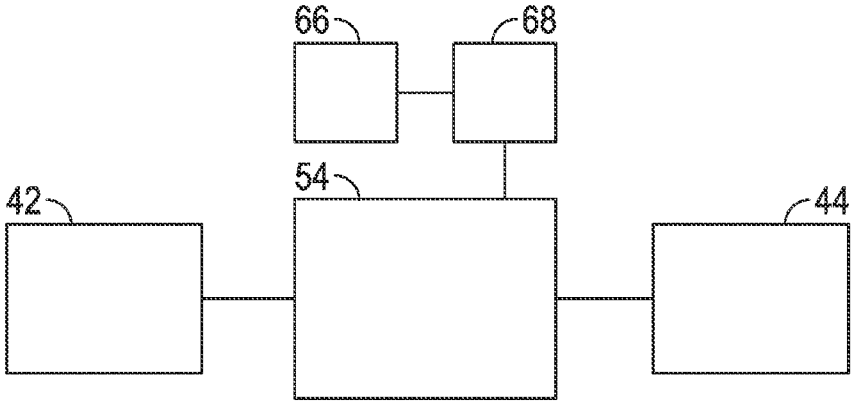
FIG. 5 is a block diagram of one embodiment of a low pressure station in accordance with the present disclosure.

Referring now to FIG. 5, in one embodiment, at each low pressure station 46, the low pressure valve 54 may be provided with a position sensor 66 to detect a position of the low pressure valve 54 and an actuator 68, connected to the position sensor 66 and configured to change the position of the low pressure valve 54. The position sensor 66 and actuator 68 may be electrically connected, via a wired or a wireless connection, to a computer system 70, which may be located within the computerized control system 25, described below in more detail, or located on the manifold trailer 26. The computer system 70 may cause the position sensor 66 to detect the position of the low pressure valve 54, whether in the open or closed position. The computer system 70 may, based on the position of the low pressure valve 54, cause the actuator 68 to move the low pressure valve 54, for example to open or close the low pressure valve 54. The position sensor 66 may be any electrical or mechanical sensor, providing an analog or digital signal, which may be interpreted by the computer system 70 to identify a current position of the low pressure valve. The actuator 68 may be any motor, hydraulic device, pneumatic device, electrical device, or other similar mechanical or digital device capable of receiving input from the computer system 70 and causing the low pressure valve 54 to move in accordance with the input of the computer system 70 or the position sensor 66. It will be understood by one skilled in the art that each of the low pressure stations 46 may have multiple connections 44 and low pressure valves 54 implemented as described above with position sensors 66 and actuators 68. The blender station 45 may also be implemented similarly or the same as described above such that each blender station 45 may be provided with a connection, a low pressure valve, and position sensors and actuators connected to the low pressure valve.

Figure 6:
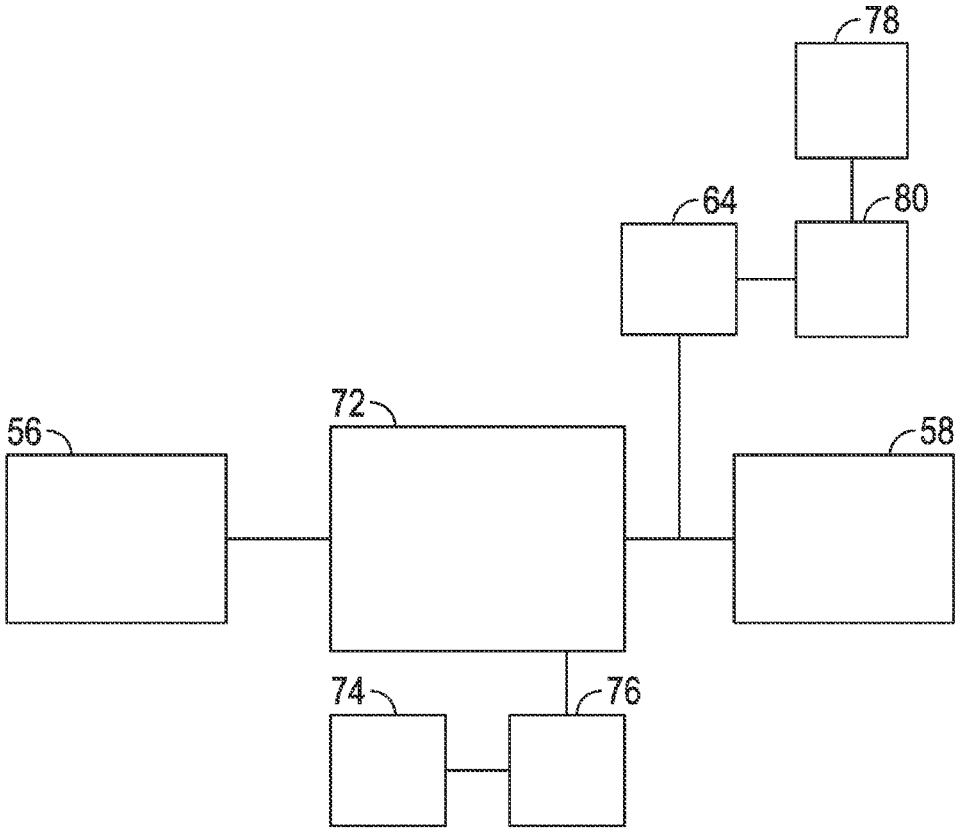
FIG. 6 is a block diagram of one embodiment of a high pressure station in accordance with the present disclosure.

Referring now to FIG. 6, at each high pressure station 60, the high pressure manifold 40 may be provided with the plug valve 72 to prevent or allow fluid transmission into the high pressure manifold 40, a position sensor 74 to detect a position of the plug valve 72, an actuator 76 connected to the position sensor 74 and configured to change the position of the plug valve 72. The high pressure manifold 40 may also be provided with a position sensor 78 connected to the high pressure bleed valve 64 and an actuator 80 connected to the high pressure bleed valve 64 and the position sensor 78. The actuator 80 may be configured to change the position of the high pressure bleed valve 64. The position sensors 74 and 78 and the actuators 76 and 80 may be connected, via wired or wireless connection, to the computer system 70 to enable detection of the positions of the plug valve 72 and the high pressure bleed valve 64 and manipulate the positions of the plug valve 72 and the high pressure bleed valve 64. The position sensors 74 and 78 may be implemented in the same or similar way to the position sensor 66 described above.

The actuators 76 and 80 may be implemented in the same or similar way to the actuator 68 described above. It will be understood by one skilled in the art that each of the high pressure stations 60 may have multiple connections 58, high pressure bleed valves 64, and plug valves 72 implemented as described above. The well bore station 62 may also be implemented similarly or the same as described above such that each well bore station 62 may be provided with a connection, a first valve, a high pressure valve, and position sensors and actuators connected to the first valve and the high pressure valve.

Figure 7:
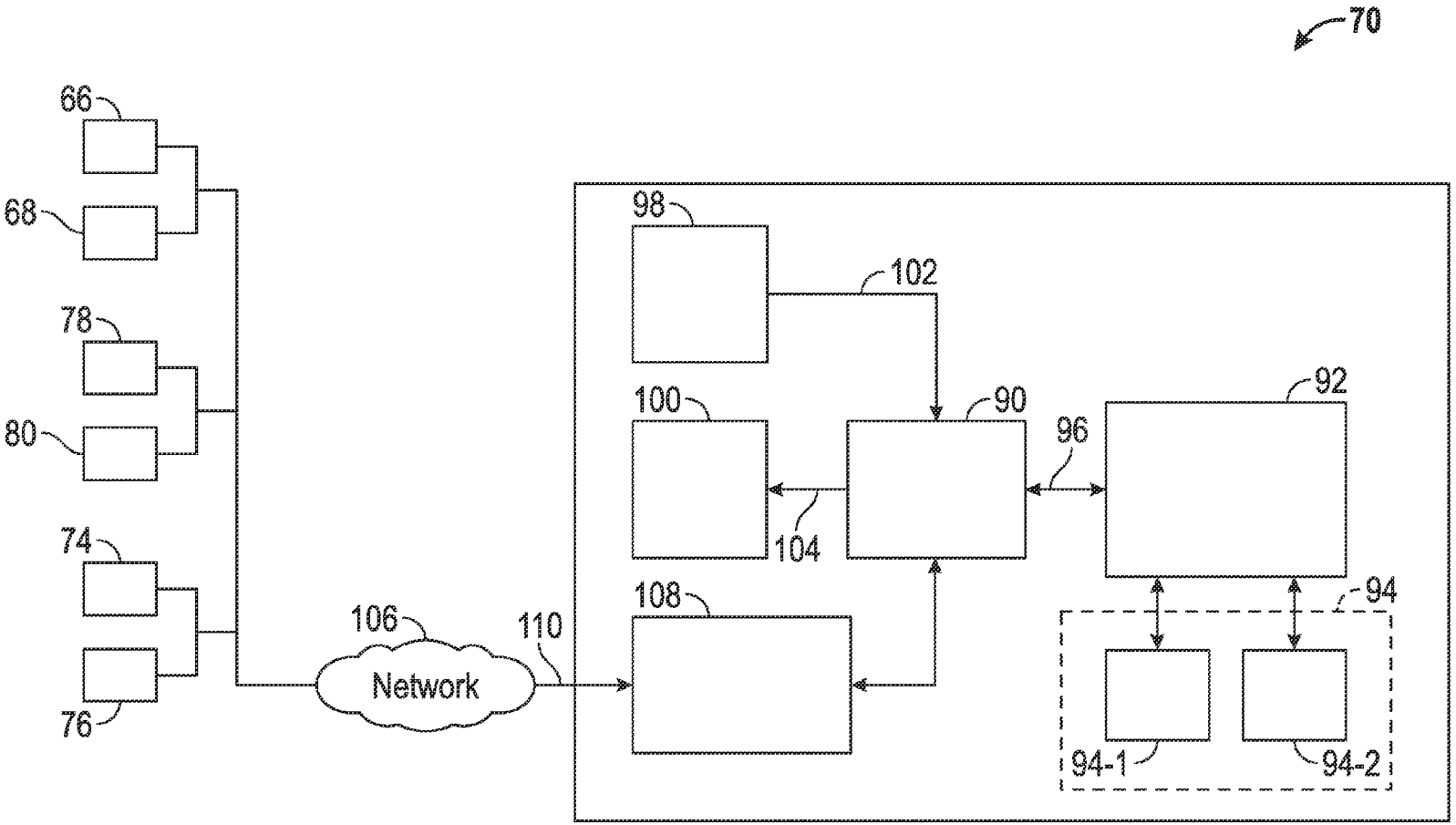
FIG. 7 is a schematic view of an embodiment of a computer system in accordance with the present disclosure.

Referring now to FIG. 7, shown therein is one embodiment of the computer system 70 connected to the manifold trailer 26. The computer system 70 may be the computerized control system 25 or may be provided within the computerized control system 25 and may comprise a processor 90, a non-transitory computer readable medium 92, and processor executable code 94 stored on the non-transitory computer readable medium 92.

The processor 90 may be implemented as a single processor or multiple processors working together or independently to execute the processor executable code 94 described herein. Embodiments of the processor 90 may include a digital signal processor (DSP), a central processing unit (CPU), a microprocessor, a multi-core processor, and combinations thereof. The processor 90 is coupled to the non-transitory computer readable medium 92. The non-transitory computer readable medium 92 can be implemented as RAM, ROM, flash memory or the like, and may take the form of a magnetic device, optical device or the like. The non-transitory computer readable medium 92 can be a single non-transitory computer readable medium, or multiple non-transitory computer readable mediums functioning logically together or independently.

The processor 90 is coupled to and configured to communicate with the non-transitory computer readable medium 92 via a path 96 which can be implemented as a data bus, for example. The processor 90 may be capable of communicating with an input device 98 and an output device 100 via paths 102 and 104, respectively. Paths 102 and 104 may be implemented similarly to, or differently from path 96. For example, paths 102 and 104 may have a same or different number of wires and may or may not include a multidrop topology, a daisy chain topology, or one or more switched hubs. The paths 96, 102 and 104 can be a serial topology, a parallel topology, a proprietary topology, or combination thereof. The processor 90 is further capable of interfacing and/or communicating with one or more network 106, via a communications device 108 and a communications link 110 such as by exchanging electronic, digital and/or optical signals via the communications device 108 using a network protocol such as TCP/IP. The communications device 108 may be a wireless modem, digital subscriber line modem, cable modem, network bridge, Ethernet switch, direct wired connection or any other suitable communications device capable of communicating between the processor 90 and the network 106.

It is to be understood that in certain embodiments using more than one processor 90, the processors 90 may be located remotely from one another, located in the same location, or comprising a unitary multicore processor (not shown). The processor 90 is capable of reading and/or executing the processor executable code 94 and/or creating, manipulating, altering, and storing computer data structures into the non-transitory computer readable medium 92.

The non-transitory computer readable medium 92 stores processor executable code 94 and may be implemented as random access memory (RAM), a hard drive, a hard drive array, a solid state drive, a flash drive, a memory card, a CD-ROM, a DVD-ROM, a BLU-RAY, a floppy disk, an optical drive, and combinations thereof. When more than one non-transitory computer readable medium 92 is used, one of the non-transitory computer readable mediums 92 may be located in the same physical location as the processor 90, and another one of the non-transitory computer readable mediums 92 may be located in a location remote from the processor 90. The physical location of the non-transitory computer readable mediums 92 may be varied and the non-transitory computer readable medium 92 may be implemented as a "cloud memory," i.e. non-transitory computer readable medium 92 which is partially or completely based on or accessed using the network 106. In one embodiment, the non-transitory computer readable medium 92 stores a database accessible by the computer system 70.

The input device 98 transmits data to the processor 90, and can be implemented as a keyboard, a mouse, a touchscreen, a camera, a cellular phone, a tablet, a smart phone, a PDA, a microphone, a network adapter, a camera, a scanner, and combinations thereof. The input device 98 may be located in the same location as the processor 90, or may be remotely located and/or partially or completely network-based. The input device 98 communicates with the processor 90 via path 102.

The output device 100 transmits information from the processor 90 to a user, such that the information can be perceived by the user. For example, the output device 100 may be implemented as a server, a computer monitor, a cell phone, a tablet, a speaker, a website, a PDA, a fax, a printer, a projector, a laptop monitor, and combinations thereof. The output device 100 communicates with the processor 90 via the path 104.

The network 106 may permit bi-directional communication of information and/or data between the processor 90, the network 106, and the manifold trailer 26. The network 106 may interface with the processor 90 in a variety of ways, such as by optical and/or electronic interfaces, and may use a plurality of network topographies and protocols, such as Ethernet, TCP/IP, circuit switched paths, file transfer protocol, packet switched wide area networks, and combinations thereof. For example, the one or more network 106 may be implemented as the Internet, a LAN, a wide area network (WAN), a metropolitan network, a wireless network, a cellular network, a GSM-network, a CDMA network, a 3G network, a 4G network, a satellite network, a radio network, an optical network, a cable network, a public switched telephone network, an Ethernet network, and combinations thereof. The network 106 may use a variety of network protocols to permit bi-directional interface and communication of data and/or information between the processor 90, the network 106, and the manifold trailer 26. The communications between the processor 90 and the manifold trailer 26, facilitated by the network 106, may be indicative of communications between the processor 90, the position sensors 66, 74, and 78, and the actuator 68, 76, and 80. The communications between the processor 90 and the manifold trailer 26 may be additionally facilitated by a controller which may interface with position sensors 66, 74, and 78 and actuators 68, 76, and 80 as well as the computer system 70. In one embodiment, the controller may be implemented as a controller on the manifold trailer 26. In another embodiment, the controller may be implemented as a part of the computer system 70 in the computerized control system 25. The controller may be implemented as a programmable logic controller (PLC), a programmable automation controller (PAC), distributed control unit (DCU) and may include input/output (I/O) interfaces such as 4-20 mA signals, voltage signals, frequency signals, and pulse signals which may interface with the position sensors 66, 74, 78 and the actuators 68, 76, and 80.

In one embodiment, the processor 90, the non-transitory computer readable medium 92, the input device 98, the output device 100, and the communications device 108 may be implemented together as a smartphone, a PDA, a tablet device, such as an iPad, a netbook, a laptop computer, a desktop computer, or any other computing device.

The non-transitory computer readable medium 92 may store the processor executable code 94, which may comprise a pairing program 94-1. The non-transitory computer readable medium 92 may also store other processor executable code 94-2 such as an operating system and application programs such as a word processor or spreadsheet program, for example. The processor executable code for the pairing program 94-1 and the other processor executable code 94-2 may be written in any suitable programming language, such as C++, C#, or Java, for example.

Figure 8:
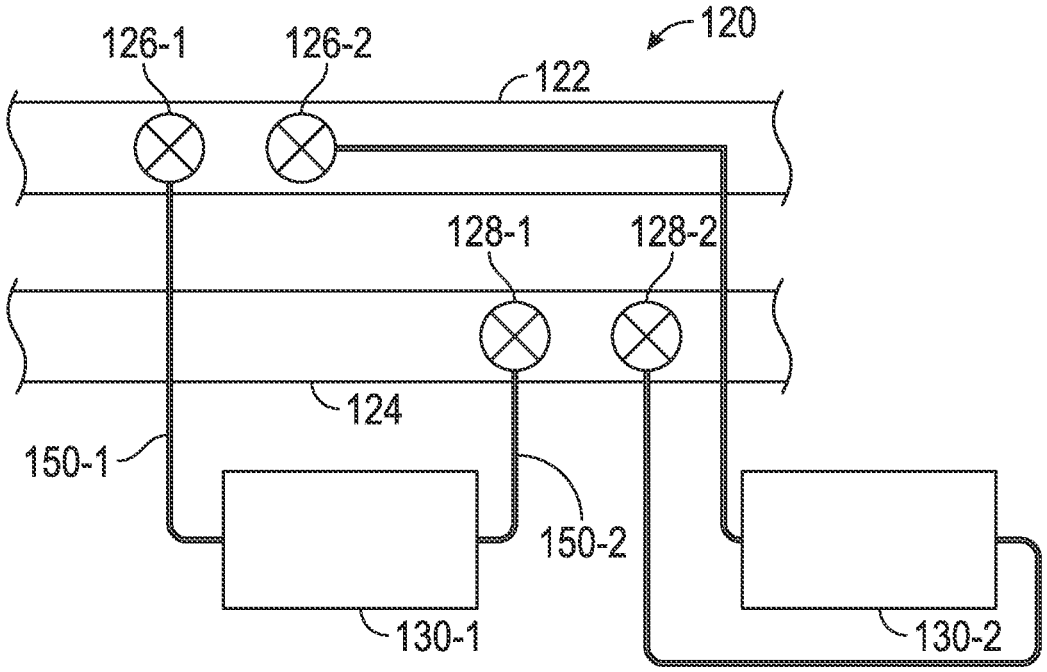
FIG. 8 is a diagrammatic representation of one embodiment of a pump system in accordance with the present disclosure.
Figure 9:
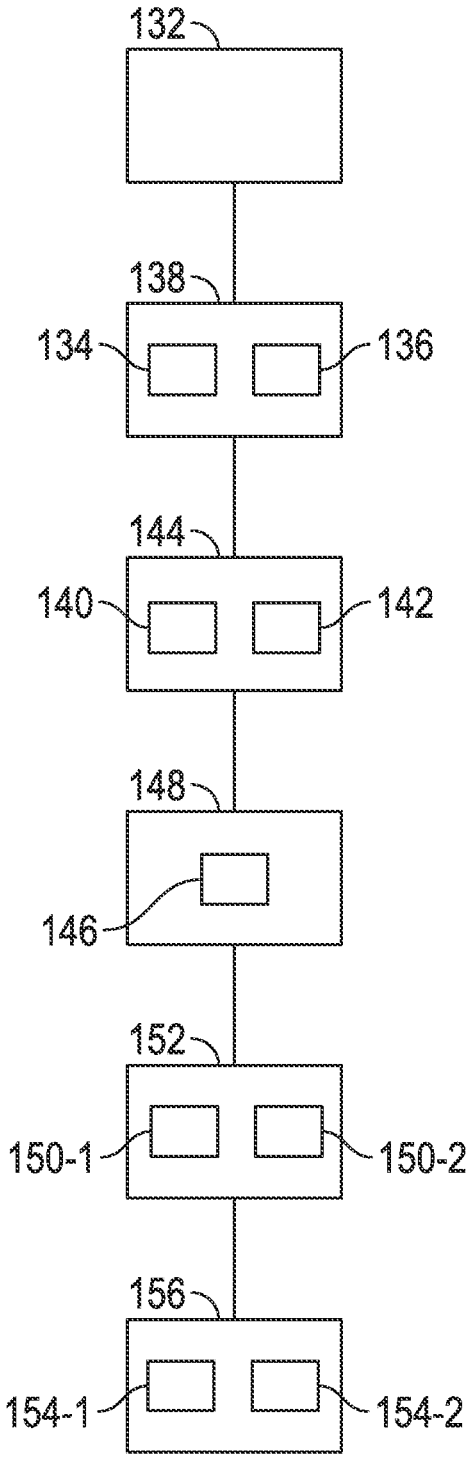
FIG. 9 is a diagrammatic representation of an embodiment of a method of automatically pairing a plurality of pumps and a plurality of valves on the manifold trailer in accordance with the present disclosure.

Referring now to FIGS. 8 and 9, therein shown is a diagrammatic representation of one embodiment of the pairing program 94-1. As shown in FIG. 8, as will be discussed in reference to the pairing program 94-1, a manifold trailer 120 is provided with a low pressure manifold 122 and a high pressure manifold 204. A first low pressure valve 126-1 and a second low pressure valve 126-2 are connected to the low pressure manifold 202. A first high pressure valve 128-1 and a second high pressure valve 128-2 are connected to the high pressure manifold 204. The first and second low pressure valves 126-1 and 126-2 and the first and second high pressure valves 128-1 and 128-2 may be in fluid communication with a first pump 130-1 and a second pump 130-2. The manifold trailer 120 may be implemented similarly to the manifold trailer 26, as described above. The first pump 130-1 and the second pump 130-2 may be implemented similarly to the fracturing pumps 30. Although shown as provided with the first and second low pressure valve 126-1 and 126-2 and the first and second high pressure valves 128-1 and 128-2, the manifold trailer 120 may be provided with a plurality of low pressure valves 126 representing any number of low pressure valves 126 and with a plurality of high pressure valves 128 representing any number of high pressure valves 128. The first and second pumps 130-1 and 130-2 may be a plurality of pumps 130 representing any number of pumps 130.

As shown in FIG. 9, the processor 90 of the computer system 70 may execute the processor executable code for the pairing program 94-1 at block 132. The pairing program 94-1 may cause the processor 90 to receive identification data 134 indicative of the first low pressure valve 126-1 and identification data 136 indicative of the second low pressure valve 126-2 connected to the low pressure manifold 122 of the manifold trailer 120, at block 138. The identification data 134 and 136 may be any information to uniquely identify the first low pressure valve 126-1 and second low pressure valve 126-2, such as IP addresses, serial numbers, or any other information. The pairing program 94-1 may cause the processor 90 to receive identification data 140 indicative of the first high pressure valve 128-1 and identification data 142 indicative of the second high pressure valve 128-2 at block 144. The identification data 140 and 142 may be any information to uniquely identify the first high pressure valve 128-1 and second high pressure valve 128-2, such as IP addresses, serial numbers, or any other information. The pairing program 94-1 may also cause the processor 90 to receive identification data 146 indicative of the first pump 130-1, at block 148.

After receiving the identification data 134, 136, 140, 142, and 146, the pairing program 94-1 may cause the processor 90 to determine a first fluid connection 150-1 between the first low pressure valve 126-1 and a selected pump 130 of the plurality of pumps 130, as shown in FIG. 8, the selected pump is the first pump 130-1, at block 152. The pairing program 94-1 may also cause the processor 90 to determine a second fluid connection 150-2 between the selected pump 130 and a selected high pressure valve 128 selected from the first and second high pressure valves 128-1 and 128-2, as shown in FIG. 8, the selected high pressure valve is the first high pressure valve 128-1, also at block 152.

After determining the first fluid connection 150-1 and the second fluid connection 150-2, the pairing program 94-1 may cause the processor 90 to populate a non-transitory computer readable medium 92 with a first association 154-1 indicative of the first fluid connection 150-1, and a second association 154-2 indicative of the second fluid connection 150-2, at block 156. Although presented as first and second associations 154-1 and 154-2, the processor 90 may populate the non-transitory computer readable medium 92 with a single association 154 indicative of the first fluid connection 150-1 and the second fluid connection 150-2.

Figure 10:
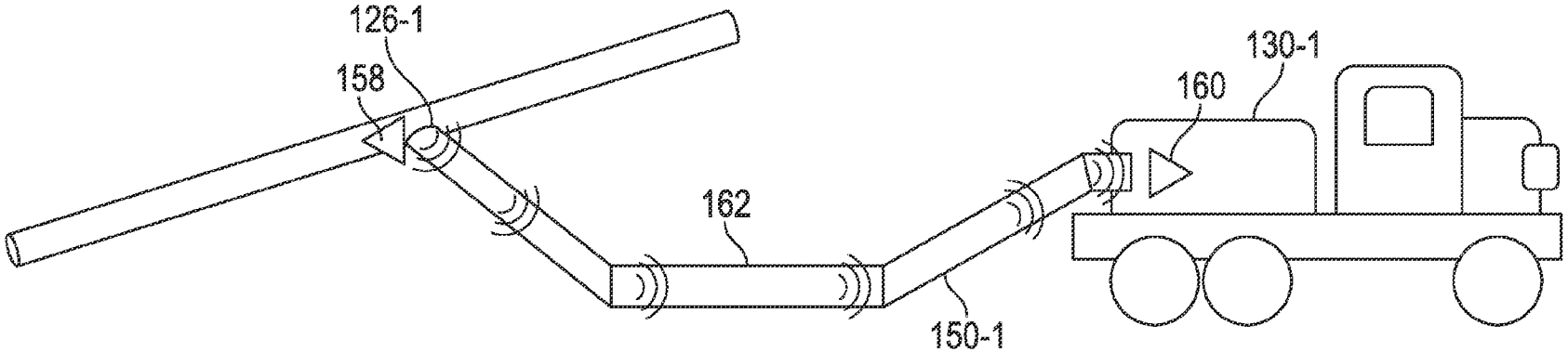
FIG. 10 is a diagrammatic representation of one embodiment of a method of determining a fluid connection for the method of automatically pairing the plurality of pumps and the plurality of valves on the manifold trailer of FIG. 9.

The first association 154-1 and the second association 154-2 may be created in a number of ways as will be described below. As shown in FIG. 10, in one embodiment, the associations 154, such as the first association 154-1, is determined by passing signals via the first fluid connection 150-1 between a first transceiver 158 located at the first low pressure valve 126-1 and a second transceiver 160 located at the first pump 130-1. As shown in FIG. 10, the first fluid connection 150-1, for example, may be formed using a hose 162 that may be referred to in the art as an iron. The signals used to form the first association 154-1 and the second association 154-2, for example, may be passed through the fracturing fluid, the hose 162, or a wired connection extending on or through the hose 162. The pairing program 94-1 may cause the processor 90 to determine the first fluid connection 150-1, and thereby the first association 154-1, by enabling the first and second transceivers 158 and 160 to swap identification data 134 and 146. This can be accomplished, for example, by transmitting a pulse or identification data 134 of the first low pressure valve 126-1 from the first transceiver 158 to the second transceiver 160. The identification data 134 can be stored in a memory or other suitable device within or accessible by the first transceiver 158. The identification data 146 can be stored in a memory or other suitable device within or accessible by the second transceiver 160.

The first and second transceivers 158 and 160 are configured to communicate via any suitable medium, such as electrical signals, optical signals, pressure signals, or acoustic signals. In any event, once the association is formed, either the first transceiver 158 or the second transceiver 160 passes a signal to the processor 90 to store the association in the non-transitory computer readable.

Figure 11:
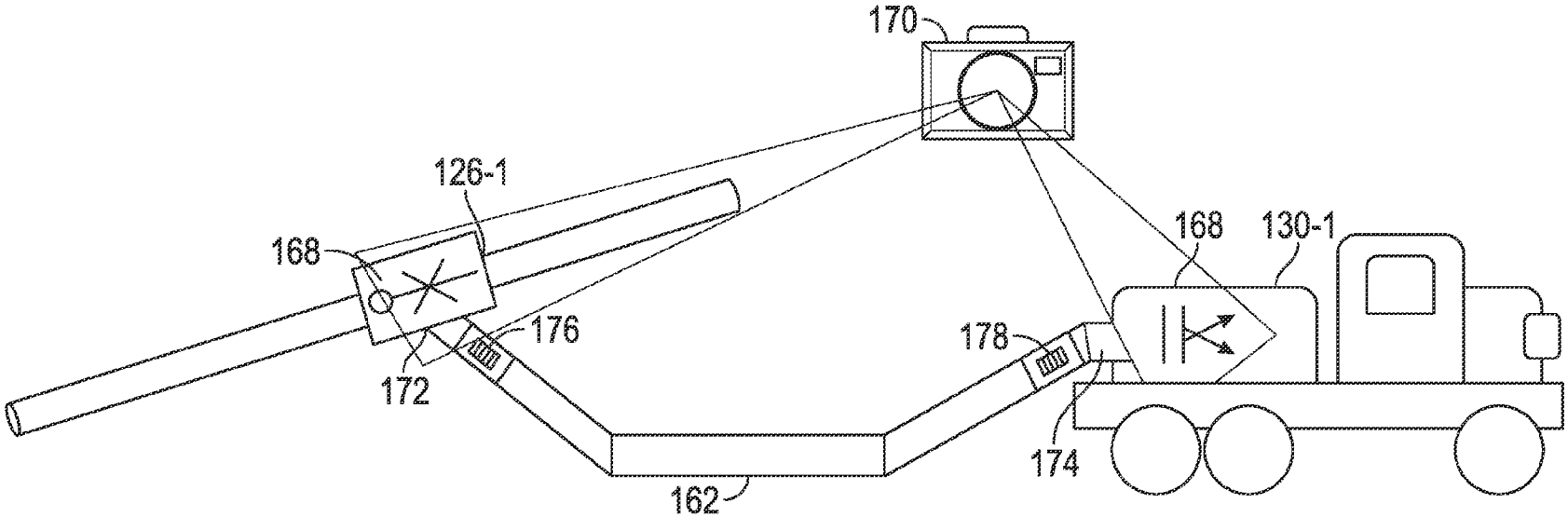
FIG. 11 is a diagrammatic representation of another embodiment of a method of determining a fluid connection for the method of automatically pairing the plurality of pumps and the plurality of valves on the manifold trailer of FIG. 9.

Referring now to FIG. 11, in another embodiment, the pump system 10 includes one or more readers 170, which are used to form the first association 154-1 and the second association 154-2. In this example, the identification data 134 of the first low pressure valve 126-1 and the identification data 146 of the first pump 130-1 may be represented by unique symbols 168, such as bar codes or other graphical symbols that are visible to or readable by the readers 170.

The hose 162 has a first end 172 and a second end 174. A first identification data 176 is applied to the hose 162 adjacent to the first end 172, and a second identification data 178 is applied to the hose 162 adjacent to the second end 174. The reader 170, which may be a camera, a bar code scanner, RFID scanner, or optical character recognition scanner, for example, may have a computer program prompting a user to capture image data, radio frequency data, or other suitable data, of the identification data 134 and the first identification data 176 to form an association of the first low pressure valve 126-1 and the first end 172 of the hose 162; the identification data 146 and the second identification data 178 to form an association of the first pump 130-1 with the second end 174 of the hose 162. Then, the reader 170 may utilize this information to form the first association 154-1.

Figure 12:
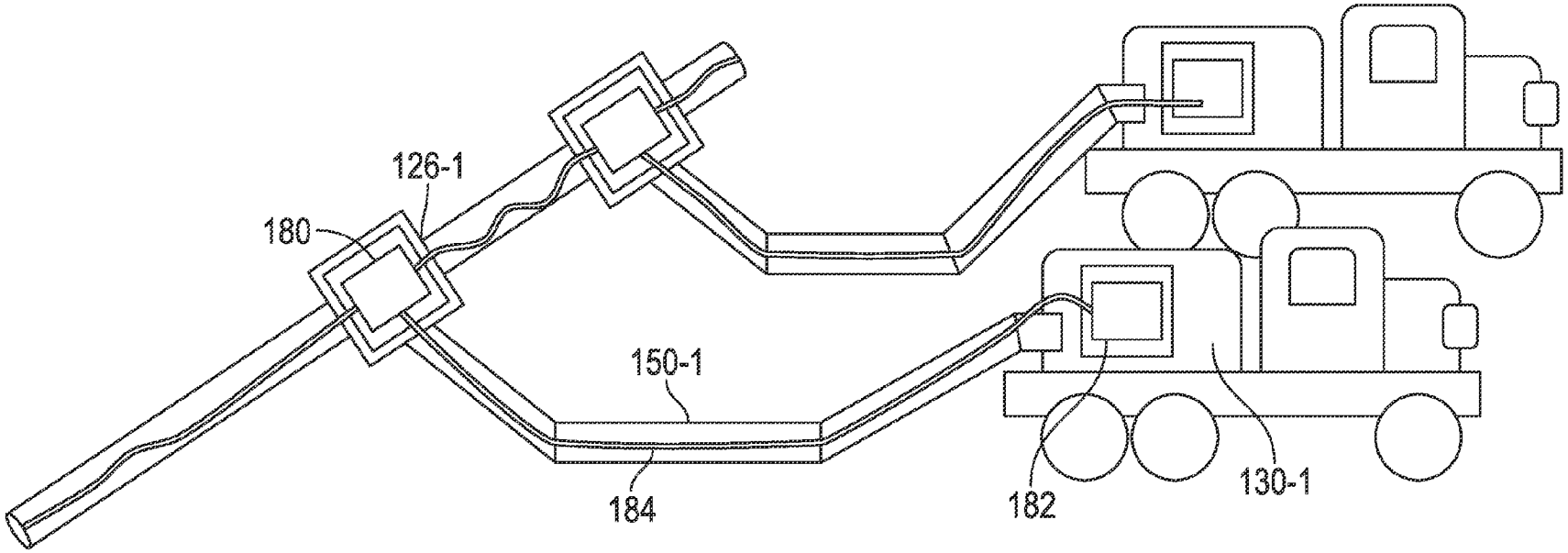
FIG. 12 is a diagrammatic representation of an embodiment of a method of determining a fluid connection for the method of automatically pairing the plurality of pumps and the plurality of valves on the manifold trailer of FIG. 9.

Referring now to FIG. 12, in yet another embodiment, the first fluid connection 150-1 may be determined by inductive coupling between a wire and a sensor. In this embodiment, the pump system 10 may include a controller 180 connected to or near the first low pressure valve 126-1 and circuitry 182 may be connected to the first pump 130-1. Upon establishing the first fluid connection 150-1 the controller 180 and the circuitry 182 may be coupled via a wired connection 184, such that the wired connection 184 inductively couples the controller 180 and the circuitry 182 such that a change in the current flow through the wired connection 184 may cause the controller 180 to receive a voltage. The controller 180 may transmit the identification data 134 for the first low pressure valve 126-1 and the identification data 146 for the first pump 130-1 to the processor 90, thereby enabling the processor 90 to determine the first fluid connection 150-1 and the first association 154-1.

Figure 13:
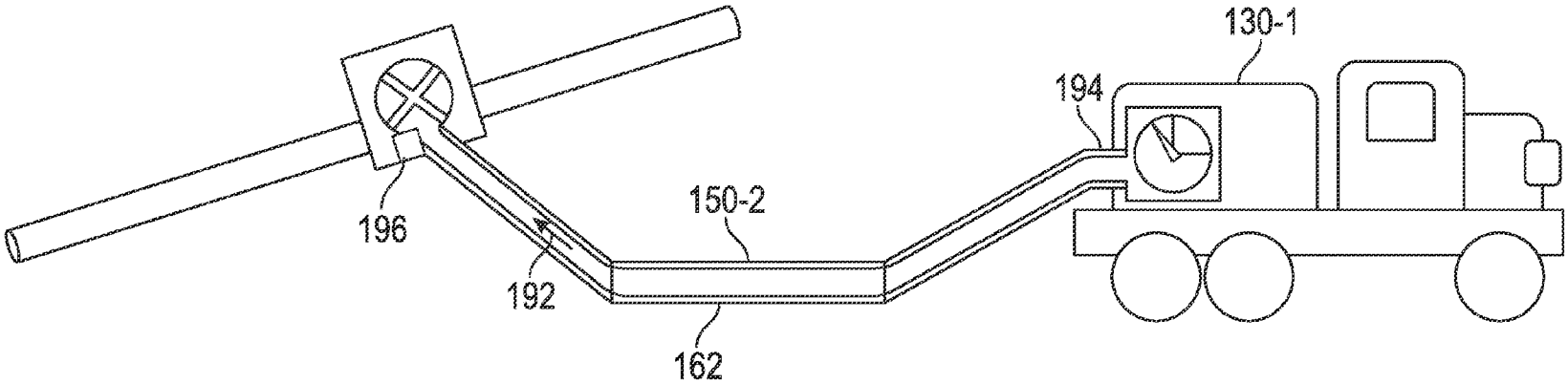
FIG. 13 is a diagrammatic representation of another embodiment of a method of determining a fluid connection for the method of automatically pairing the plurality of pumps and the plurality of valves on the manifold trailer of FIG. 9.

Referring now to FIG. 13, in one embodiment, the second fluid connection 150-2 may be determined by passing pressure pulses through the hose 162. In this embodiment, the processor 90 may receive the identification data 146 of the first pump 130-1 and cause the first pump 130-1 to generate a pressure pulse 192 in a pump output 194 connected to the hose 162. The pressure pulse 192 may be generated by initiating the first pump 130-1 for a predetermined number of revolutions. The first pump 130-1 generating the pressure pulse 192, may cause the pressure pulse 192 to be within a safety threshold of the first high pressure valve 128-1 and allow a transmission of the first pump 130-1 to stall before the pressure at the pump output 194 exceeds the safety threshold of the first high pressure valve 128-1. The pressure pulse 192 may be detected by a sensor 196 mounted on the first high pressure valve 128-1, causing the sensor to transmit the identification data 140 of the first high pressure valve 128-1 to the processor 90, thereby enabling the processor 90 to determine the second fluid connection 150-2 and the second association 154-2.

Figure 14:
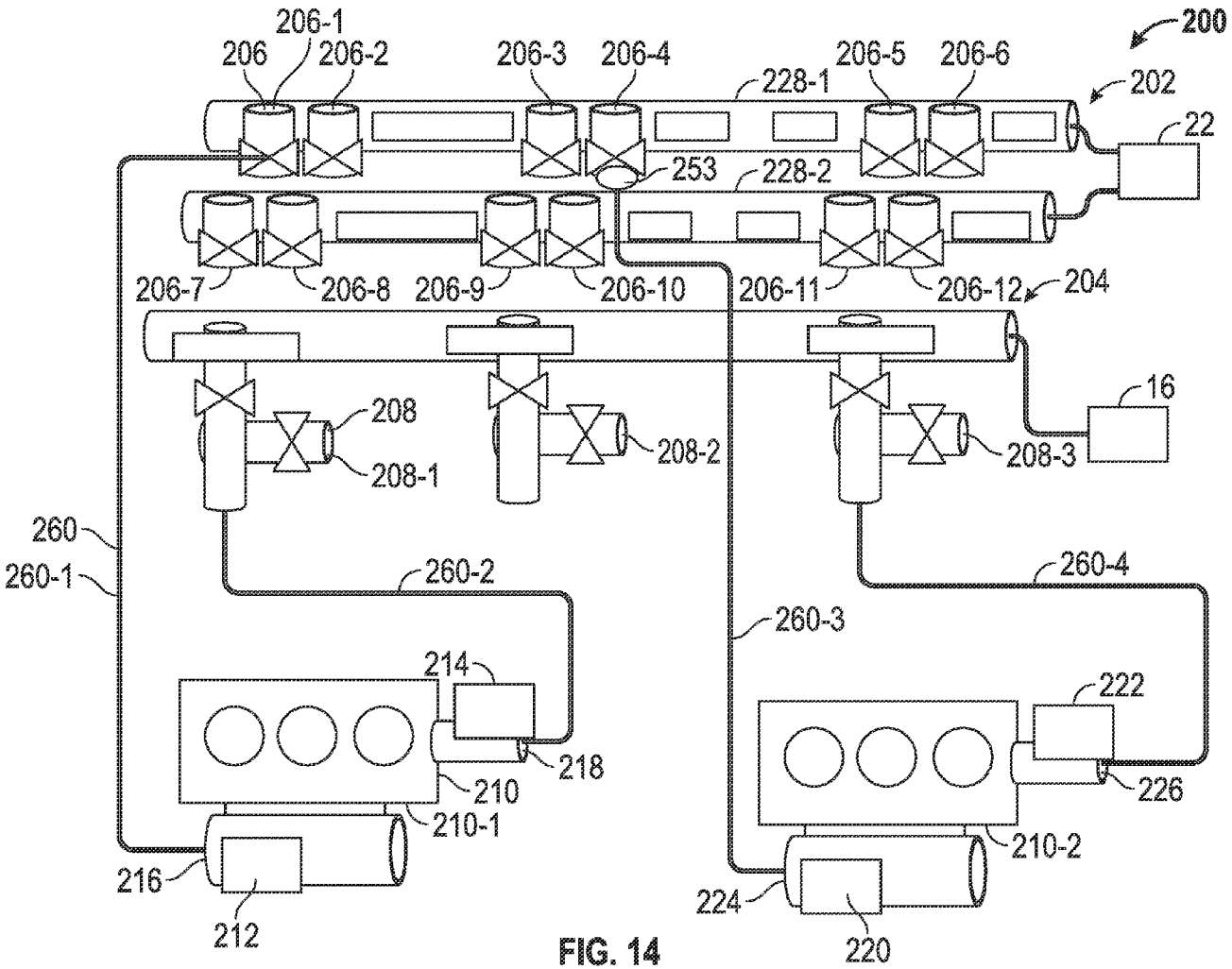
FIG. 14 is a diagrammatic representation of one embodiment of a pump system in accordance with the present disclosure.
Figure 15:
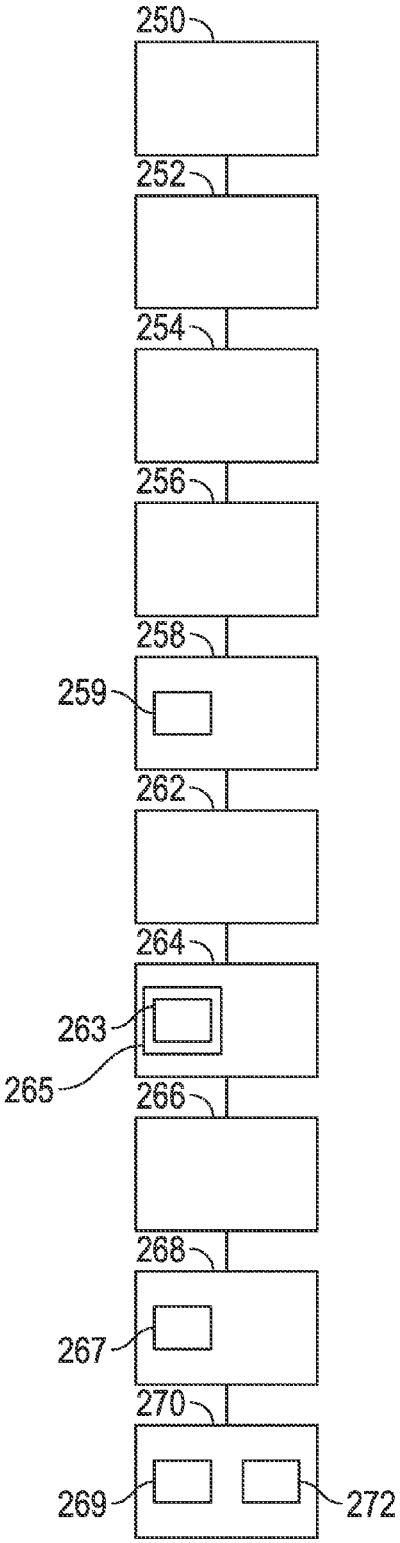
FIG. 15 is a diagrammatic representation of a method of automatically pairing a plurality of pumps and a plurality of valves on the manifold trailer in accordance with the present disclosure.

Referring now to FIGS. 14 and 15, therein shown is a diagrammatic representation of one embodiment of the pairing program 94-1. As shown in FIG. 15, as will be discussed in reference to the pairing program 94-1, a manifold trailer 200, that is constructed similar to the manifold trailer 26, is provided with a low pressure manifold 202 and a high pressure manifold 204. The low pressure manifold 202 is provided with a plurality of low pressure valves 206, including a first low pressure valve 206-1, a second low pressure valve 206-2, a third low pressure valve 206-3, and a fourth low pressure valve 206-4. The high pressure manifold 204 is provided with a plurality of high pressure valves 208-1-208-3, including a first high pressure valve 208-1, a second high pressure valve 208-2, and a third high pressure valve 208-3.

Also shown in FIG. 15 are a plurality of fracturing pumps 210, including a first fracturing pump 210-1 and a second fracturing pump 210-2. The first fracturing pump 210-1 is provided with a first pressure sensor 212, a second pressure sensor 214, a first port 216, and a second port 218 where the first pressure sensor 212 detects pressure changes at or near the first port 216 and the second pressure sensor 214 detects pressure changes at or near the second port 218. The second fracturing pump 210-2 is provided with a first pressure sensor 220, a second pressure sensor 222, a first port 224, and a second port 226 where the first pressure sensor 220 detects pressure changes at or near the first port 224 and the second pressure sensor 222 detects pressure changes at or near the second port 226. The first and second fracturing pumps 210-1 and 210-2 and the first pressure sensors 212 and 220 are in fluid communication with the first and second low pressure valves 206-1 and 206-4 via the first ports 216 and 224, respectively. The first and second fracturing pumps 210-1 and 210-2 and the second pressure sensors 214 and 222 are in fluid communication with the first and second high pressure valves 208-1 and 208-3 via the second ports 218 and 226, respectively. In one embodiment, the first pressure sensor 212 and the second pressure sensor 214 for the first fracturing pump 210-1 may be a single pressure sensor. In one embodiment, the first pressure sensor 212 may be a low pressure sensor sensing in a range of 0 to 150 psi, and the second pressure sensor 214 may be a high pressure sensor sensing in a range of 0 to 20,000 psi. In this embodiment, the low pressure sensor may be used for pairing the high pressure bleed valves 64, the fracturing pump 210, and the low pressure valves 126 because the low pressure sensor has greater resolution.

As will be discussed in more detail below, the pairing program 94-1 may comprise an automated process for determining fluid connections between any of the plurality of low pressure valves 206 with any of the plurality of fracturing pumps 210 and any of the plurality of high pressure valves 208. Although shown in FIG. 15 as being provided with twelve low pressure valves 206-1-206-12 and three high pressure valves 208-1-208-3, it will be understood by one skilled in the art that the manifold trailer 200 may be provided with greater or fewer low pressure valves 206 and high pressure valves 208. Similarly, although depicted with fluid connections to two fracturing pumps 210-1 and 210-2, it will be understood that any number of fracturing pumps 210 may be provided such that each of the plurality of low pressure valves 206 may be connected to a separate fracturing pump 210 and correspond to one of the high pressure valves 208 such that the low pressure valve 206, the fracturing pump 210 and the high pressure valve 208 form a single fluid connection. For example, the first low pressure valve 206-1 is connected to the first fracturing pump 210-1 via the first fluid connection 260-1, and the first fracturing pump 210-1 is connected to the first high pressure valve 208-1, thereby corresponding to the first low pressure valve 206-1.

Referring now to FIG. 15, in one embodiment, the processor 90 of the computer system 70 may execute the processor executable code for the pairing program 94-1 at block 250. In one embodiment, at block 252, the processor 90 may also determine whether the first low pressure valve 206-1 and the plurality of high pressure valves 208 are in fluid communication with the plurality of pumps 210, such that each of the plurality of low pressure valves 206 and the plurality of high pressure valves 208 are connected to one of the fracturing pumps 210. In this embodiment, any of the low pressure valves 206 or the high pressure valves 208 without a connection to one of the plurality of fracturing pumps 210 may no longer be utilized by the processor 90 during operation of the pairing program 94-1. Further if the first low pressure valve 206-1 is not in fluid communication with one of the plurality of fracturing pumps 210, the processor 90 may restart the pairing program 94-1 beginning with a subsequent low pressure valve of the plurality of low pressure valves 206. In the event that one of the plurality of fracturing pumps 210 that is known to be present is not automatically paired successfully, an operator may have the ability to manually pair the fracturing pump 210 not automatically paired to a low pressure valve 206 and one or more high pressure valve 208 using a user interface on the computer system 70.

The processor 90, in one embodiment, may determine whether each of the low pressure valves 206 are in fluid communication with the plurality of fracturing pumps 210 using a sensor 253 with a spring return capability, as shown connected to the fourth low pressure valve 206-4 in FIG. 15. The sensor 253 may be installed on each low pressure valve 206 connection. The sensor 253 may prevent a hose, which may be used to connect one of the low pressure valves 206 to one of the fracturing pumps 210, from being connected via gravity, spring action, or other mechanism. The placement of the sensor 253 may necessitate the sensor 253 being moved to install the hose, thereby generating a signal to the computer system 70 indicative of the hose being connected to the low pressure valve 206. When the hose is removed, the sensor 253 may return to its natural position and break the signal, indicating no hose is connected. The signal may thereby be indicative of a failsafe such that if the sensor 253 fails, the low pressure valve 206 is indicated to the computer system 70 as having no hose connection.

In another embodiment, the sensor 253 may be replaced by installation of caps (not shown) on unused low pressure valves 206, where the caps may prevent unintentional fluid discharge and be used to identify whether the hose is connected. If the low pressure valve 206, with the cap installed, is opened, no pressure increase may be detected at the plurality of fracturing pumps 210, thereby allowing a user to identify the low pressure valve 206 with the cap as not connected to a hose or fracturing pump 210.

The pairing program 94-1 may cause the processor 90 to determine a status of the first low pressure valve 206-1 and the plurality of high pressure valves 208, at block 254. In one embodiment, the processor 90 also determines the status of the plurality of plug valves 72. The status may indicate whether the first low pressure valve 206-1 and the plurality of high pressure valves 208 are open, closed, or in an intermediate status between open and closed. The processor 90 may determine the status of the first low pressure valve 206-1 and the plurality of high pressure valves 208 using the position sensors 66 and 78, respectively, connected to the first low pressure valve 206-1 and the plurality of high pressure valves 208, as previously discussed. At block 254, if the processor 90 determines the first low pressure valve 206-1 or one or more of the plurality of high pressure valves 208 are open or in the intermediate status, the processor 90 may cause the actuators 68 and 80, respectively, connected to the first low pressure valve 206-1 or the plurality of high pressure valves 208 to close the respective valves to which the actuators 68 and 80 are connected.

After determining the status of the first low pressure valve 206-1 and the high pressure valves 208, the processor 90 may pressurize the low pressure manifold 202 of the manifold trailer 200, at block 256. The processor 90 may pressurize the low pressure manifold 202 by opening one or more connections between the low pressure manifold 202 and the blender 22, such as the connections 44 of the blender station 45, discussed above in reference to FIGS. 2-4, for example. Opening one or more connections between the low pressure manifold 202 and the blender 22 may allow pressure from the blender 22 to pressurize pipes 228-1 and 228-2, as shown in FIG. 15, without initiation of the plurality of pumps 210. In one embodiment, the one or more connections opened to pressurize the low pressure manifold 202 may be closed after the low pressure manifold 202 has been pressurized.

At block 258, the pairing program 94-1 may cause the processor 90 to initiate the actuator 68 connected to the first low pressure valve 206-1 to open the low pressure valve 206-1. It will be understood by one skilled in the art that the pairing program 94-1 may select any of the plurality of low pressure valves 206-1 as the first low pressure valve to be opened. Opening the first low pressure valve 206-1 may cause a first fluid connection 260-1 to be pressurized. The processor 90 may receive a signal 259 from the first pressure sensor 212 of the first pump 210-1 indicative of a pressure increase on the first pump 210-1 and the first fluid connection 260-1 to the first low pressure valve 206-1. The processor 90 may then close the first low pressure valve 206-1 by initiating the actuator 68 connected to the first low pressure valve 206-1, thereby retaining pressure between the low pressure valve 206-1 and the first pump 210-1 within the first fluid connection 260-1, at block 262.

The processor 90 may then form and store information indicative of an association 263 between the first low pressure valve 206-1 with the first pump 210-1 at block 264, within the one or more non-transitory computer readable medium 92. For example, the processor 90 may store the association 263 of the first low pressure valve 206-1 and the first pump 210-1 in a data structure 265, such as a database of associations, a spread sheet, or any other suitable data storage such that the association may be viewed, edited, modified, or recalled by a user and such that the user may positively identify the association of the first low pressure valve 206-1 and the first pump 210-1.

The processor 90 may then selectively open and close, individually, the plurality of high pressure valves 208, at block 266. The processor 90 may also detect a pressure decrease on the first pump 210-1 via a signal 267 from the second pressure sensor 214 for a selected high pressure valve 208, at block 268. As shown in FIG. 14, for example, the processor 90 may open the first high pressure valve 208-1 and detect a pressure decrease on the first pump 210-1. The selected high pressure valve 208 may be any of the plurality of high pressure valves 208 which is connected to the pump 210 that was determined to have a fluid connection with the first low pressure valve 206-1 in block 258.

Once the processor 90 has detected the decrease in pressure via the signal 267 communicated by the second pressure sensor 214, the processor 90 may form an association 269 between the selected high pressure valve 208 and the first pump 210-1, at block 270. In one embodiment, the processor 90 may associate the first high pressure valve 208-1 with the first pump 210-1 by storing the association 269 within the one or more non-transitory computer readable medium 92. For example, the processor 90 may store the association of the first high pressure valve 208-1 and the first pump 210-1 in the data structure 265 such that the user may positively identify the association of the first high pressure valve 208-1 and the first pump 210-1 along in the same data structure 265 as the association of the first low pressure valve 206-1 and the first pump 210-1. In one embodiment, the processor 90 may additionally form an association 272 between the first low pressure valve 206-1, the first pump 210-1, and the first high pressure valve 208-1, similar to the associations 263 and 269, such that a first fluid connection 260-1 and a second fluid connection 260-2 between the first low pressure valve 206-1 and the first high pressure valve 208-1 may be identified.

After the processor 90 has formed the associations 263 and 269 for the first low pressure valve 206-1, the first pump 210-1, and the first high pressure valve 208-1, this process may be repeated using any suitable predetermined or random pattern to selectively open and close each of the plurality of low pressure valves 206, individually, detecting a pressure increase on a selected pump of the plurality of pumps 210, corresponding to opening a selected low pressure valve 208, and associating the selected low pressure valve 208 with the selected pump 210. The processor 90 may also repeat the process to selectively open and close, individually, the plurality of high pressure valves 208, detecting a pressure decrease on the selected pump 210, corresponding to opening a selected high pressure valve 208, corresponding to opening a selected high pressure valve 208, and associating the selected high pressure valve 208 with the selected pump 210. The processor 90 may repeat the process until each of the plurality of low pressure valves 206 is associated with one of the plurality of pumps 210, and until each of the plurality of high pressure valves 208 is associated with one of the plurality of pumps 210.

Although a few embodiments of the present disclosure have been described in detail above, those of ordinary skill in the art will readily appreciate that many modifications are possible without materially departing from the teachings of the present disclosure. Accordingly, such modifications are intended to be included within the scope of the present disclosure as defined in the claims.

What is claimed is:

1. One or more non-transitory computer readable medium storing processor executable code that when executed by one or more processor cause the one or more processor to:

receive identification data indicative of a first low pressure valve and a second low pressure valve, the first and second low pressure valves connected to a low pressure manifold of a manifold trailer;

receive identification data indicative of a first high pressure valve at a first high pressure station and a second high pressure valve at a second high pressure station, the first and second high pressure valves connected to a high pressure manifold of the manifold trailer;

receive identification data indicative of a plurality of pumps;

determine a first association indicative of a first fluid connection between the first low pressure valve and a selected pump of the plurality of pumps and a second association indicative of a second fluid connection between the selected pump and a selected high pressure valve selected from the first and second high pressure valves; and populate a non-transitory computer readable medium with information indicative of the first association and the second association, wherein the non-transitory computer readable medium is populated by the processor executable code causing the one or more processor to:

pressurize the low pressure manifold;

open a selected low pressure valve of the first and second low pressure valves;

detect a pressure increase on a pump, via a first pressure sensor;

close the selected low pressure valve retaining pressure between the selected low pressure valve and the pump;

associate the selected low pressure valve with the pump and store information indicative of the first association in the non-transitory computer readable medium;

selectively open and close, individually, the first and second high pressure valves;

detect a pressure decrease on the pump via a second pressure sensor for a selected high pressure valve of the first and second high pressure valves; and associate the selected high pressure valve with the pump and store information indicative of the second association in the non-transitory computer readable medium.

2. The one or more non-transitory computer readable medium of claim 1, further comprising associating the second low pressure valve with a second pump and a second high pressure valve.

3. The one or more non-transitory computer readable medium of claim 1, wherein the processor executable code further causes the processor to close the first low pressure valve, the second low pressure valve, the first high pressure valve, and the second high pressure valve, the first and second low pressure valves connected to the low pressure manifold, the first high pressure valve at the first high pressure station and the second high pressure valve connected to the high pressure manifold, the low pressure manifold and the high pressure manifold being in fluid communication with the pump of the plurality of pumps.

4. The one or more non-transitory computer readable medium of claim 1, wherein the processor executable code causes a blender to pressurize the low pressure manifold without initiating the plurality of pumps.

5. The one or more non-transitory computer readable medium of claim 1, wherein the processor executable code further causes the one or more processor to associate the first low pressure valve with the pump and the selected high pressure valve.

6. A method, comprising:

pressurizing a low pressure manifold of a manifold trailer, the low pressure manifold having a first low pressure valve and a second low pressure valve;

opening a selected low pressure valve of the first and second low pressure valves;

detecting a pressure increase on a selected pump, via a first pressure sensor, indicative of a fluid communication between the selected low pressure valve and the selected pump;

closing the selected low pressure valve to retain pressure between the selected low pressure valve and the selected pump;

associating the selected low pressure valve with the selected pump and storing information indicative of the association of the selected low pressure valve and the selected pump in a non-transitory computer readable medium;

selectively opening and closing, individually, a first high pressure valve at a first high pressure station and a second high pressure valve at a second high pressure station, the first and second high pressure valves in fluid communication with a high pressure manifold on the manifold trailer;

detecting a pressure decrease on the selected pump via a second pressure sensor indicative of a fluid communication between a selected high pressure valve of the first and second high pressure valves and the selected pump; and associating the selected high pressure valve with the selected pump and storing information indicative of the association of the selected high pressure valve and the selected pump in the non-transitory computer readable medium.

7. The method of claim 6, further comprising associating the second low pressure valve with a second selected pump and a second selected high pressure valve.

8. The method of claim 6, further comprising initially closing the first low pressure valve, the second low pressure valve, the first high pressure valve at the first high pressure station, and the second high pressure valve at the second high pressure station.

9. The method of claim 6, wherein the low pressure manifold is pressurized by a blender without initiating the selected pump.

10. The method of claim 6, further comprising associating the first low pressure valve with the selected pump and the selected high pressure valve.

11. A manifold trailer, comprising:

a low pressure manifold having a first low pressure valve and a second low pressure valve;

a high pressure manifold having a first high pressure valve at a first high pressure station and a second high pressure valve at a second high pressure station;

a plurality of actuators, wherein a first actuator of the plurality of actuators is connected to the first low pressure valve, a second actuator of the plurality of actuators is connected to the second low pressure valve, a third actuator of the plurality of actuators is connected to the first high pressure valve, and a fourth actuator of the plurality of actuators is connected to the second high pressure valve; and a computer system having a processor and processor executable code which causes the processor to transmit signals to the first, second, third, and fourth actuators to selectively open and close the first and second low pressure valves and the first and second high pressure valves, wherein the processor executable code further causes the processor to:

pressurize the low pressure manifold;

open a selected low pressure valve of the first and second low pressure valves;

detect a pressure increase on a first pump of a plurality of pumps, via a first pressure sensor, corresponding to the opening of the selected low pressure valve and close the selected low pressure valve retaining pressure between the selected low pressure valve and the first pump;

associate the selected low pressure valve with the first pump within one or more non-transitory computer readable medium and store information indicative of the association of the selected low pressure valve and the first pump in the non-transitory computer readable medium;

selectively open and close, individually, the first high pressure valve at the first high pressure station and second high pressure valve at the second high pressure station;

detect a pressure decrease on the first pump via a second pressure sensor corresponding to the opening of a selected high pressure valve of the first and second high pressure valves; and associate the selected high pressure valve with the first pump within the non-transitory computer readable medium and store information indicative of the association of the selected high pressure valve and the first pump in the non-transitory computer readable medium.

12. The manifold trailer of claim 11, wherein the processor executable code further causes the processor to repeat the process for the second low pressure valve, associating second low pressure valve with a second pump of the plurality of pumps and associating a second selected high pressure valve of the first and second high pressure valves with the second pump.

13. The manifold trailer of claim 12, further comprising a plurality of sensors, wherein a first sensor is connected to the first low pressure valve, a second sensor is connected to the second low pressure valve, a third sensor is connected to the first high pressure valve, and a fourth sensor is connected to the second high pressure valve.

14. The manifold trailer of claim 13, wherein the processor executable code further causes the processor to receive signals from the first, second, third, and fourth sensors to determine whether the first and second low pressure valves and the first and second high pressure valves are open or closed.

15. The manifold trailer of claim 11, wherein the processor executable code further causes the processor to initially cause the first, second, third, and fourth actuators to close the first and second low pressure valves and the first and second high pressure valves.

* * * * *